US006926301B2

(12) United States Patent
Emanuele et al.

(10) Patent No.: US 6,926,301 B2
(45) Date of Patent: Aug. 9, 2005

(54) FOLDABLE SKI CONSTRUCTION

(76) Inventors: Ivan Americano Emanuele, Via Monte Bianco, 87, 20051 Limbiate (Milano) (IT); Tiziano Lanza, Via Mons, Paolo Borroni, 6, 22066 Mariano Comense (Como) (IT)

( * ) Notice: Subject to any disclaimer, the term of this patent is extended or adjusted under 35 U.S.C. 154(b) by 63 days.

(21) Appl. No.: 10/308,380

(22) Filed: Dec. 3, 2002

(65) Prior Publication Data

US 2004/0046363 A1 Mar. 11, 2004

(30) Foreign Application Priority Data

Sep. 11, 2002 (IT) ..... MI2002A1930

(51) Int. Cl.[7] ..... A63C 5/02
(52) U.S. Cl. ..... 280/603
(58) Field of Search ..... 280/603, 14.21, 280/20, 87.05; 403/83, 84, 93, 103

(56) References Cited

U.S. PATENT DOCUMENTS

| | | | | | |
|---|---|---|---|---|---|
| 1,317,770 | A | * | 10/1919 | Winter | 280/603 |
| 2,332,404 | A | * | 10/1943 | Beaton | 280/603 |
| 2,791,435 | A | * | 5/1957 | Meland | 280/603 |
| 3,689,093 | A | * | 9/1972 | Meland et al. | 280/603 |
| 3,948,535 | A | * | 4/1976 | Negi | 280/816 |
| 4,632,418 | A | * | 12/1986 | Brue Moya et al. | 280/603 |
| 5,044,044 | A | * | 9/1991 | Young et al. | 16/323 |
| 6,616,170 | B1 | * | 9/2003 | Quarti | 280/603 |
| 2002/0063411 | A1 | * | 5/2002 | Feng | 280/278 |

FOREIGN PATENT DOCUMENTS

| | | | | |
|---|---|---|---|---|
| EP | 0 042 449 | * | 6/1980 | A63C/5/02 |
| FR | 2 780 293 | * | 12/1999 | A63C/5/02 |
| JP | 6-198017 | * | 7/1994 | A63C/5/02 |

* cited by examiner

*Primary Examiner*—Frank Vanaman
(74) *Attorney, Agent, or Firm*—Hedman & Costigan, P.C.

(57) ABSTRACT

A foldable ski construction comprises a front ski portion and at least a rear ski portion, coupled by at least an foldaway articulated joint, defining at least two positions, i.e. a use position, in which the ski portions are axially aligned, and a folded position, in which the ski portions are substantially parallel and adjoining one another.

3 Claims, 9 Drawing Sheets

FOLDABLE SKI CONSTRUCTION

BACKGROUND OF THE INVENTION

The present invention relates to a foldable ski construction.

As is known, because of their comparatively great length, which can exceed two meters, skis cannot be easily transported.

For transporting skis on a car, in particular, said skis are conventionally coupled to ski holder constructions arranged on the car roof, or, in a bus, they are arranged on specially designed ski holders, which are usually provided on the rear outside surface of the bus.

The use of a ski holder on a car roof causes a deterioration of the aerodynamic properties of the car, with a consequent increase of the fuel consumption and, in a case of a side wind, a driving instability.

Moreover, a transportation of skis on a car roof is also dangerous, since the skis can fall off or be loosened.

Another problem related to the transportation of skis on an outer surface of the vehicle, is that they could be easily stolen.

Actually, in some cars, an opening is provided through the backrest of the rear seat for arranging the skies in the car baggage with a portion of said skis arranged at the central portion of the rear seat. This solution, however, is limited to cars of a comparatively large size and, anyhow, hinders the movements of the rear seat passengers.

With respect to transportation by train, it should be pointed out that frequently it is not possible to transport skis in passenger cars, and they must be necessarily stored in the baggage car.

SUMMARY OF THE INVENTION

The aim of the present invention is to provide a foldable ski construction, designed for overcoming the above mentioned problems related to the transportation of skis.

Within the scope of the above mentioned aim, a main object of the invention is to provide such a ski construction allowing to fold and extend the skis, by a quick and easy operation.

Another object of the present invention is to provide such a foldable ski construction, which is reliable and safe in operation.

Yet another object of the present invention is provide such a ski allowing to reduce to at least a half the ski size, with respect to a use condition thereof, thereby allowing the folded skis to be arranged in any car baggage, or even in bags, cases or the like.

According to one aspect of the present invention, the above mentioned aim and objects, as well as yet other objects, which will become more apparent hereinafter, are achieved by a foldable ski construction, characterized in that said foldable ski construction comprises at least a front ski portion and at least a rear ski portion, coupled by at least a foldaway articulated joint means, adapted to define at least two positions, a use position, in which said ski portions are axially aligned, and a folded position, in which said ski portions are substantially adjoining and parallel one another.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of an indicative, but not limitative, example in the accompanying drawings, where.

DESCRIPTION OF THE PREFERRED EMBODIMENTS

Figure 1:
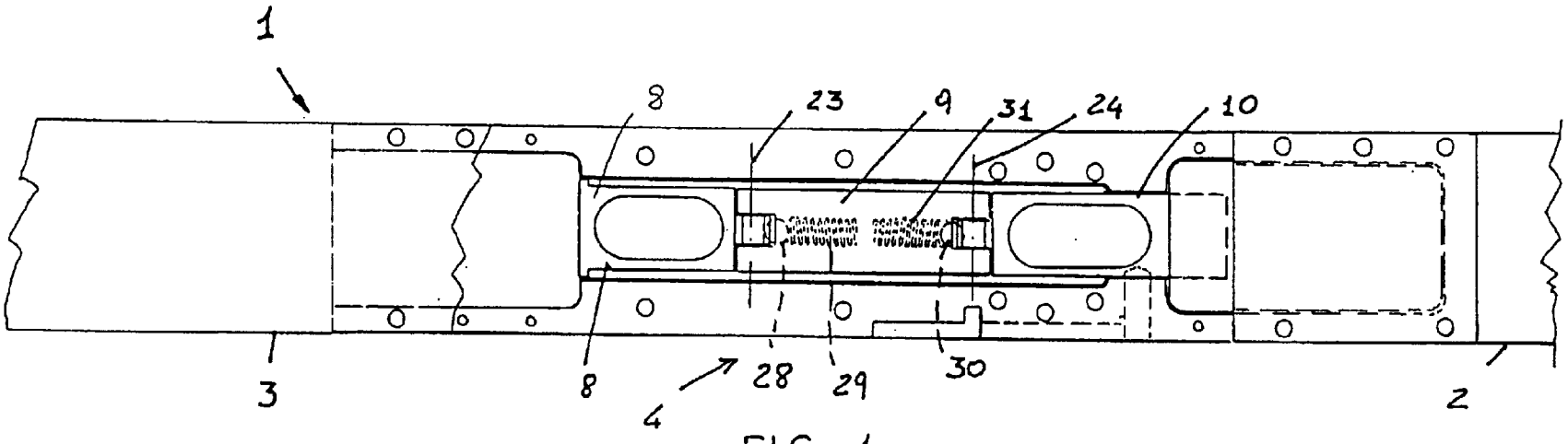
FIG. 1 is a partial top plan view of the articulation region of a ski construction according to the present invention, the ski being shown in a non folded partially cutaway condition.
Figure 2:
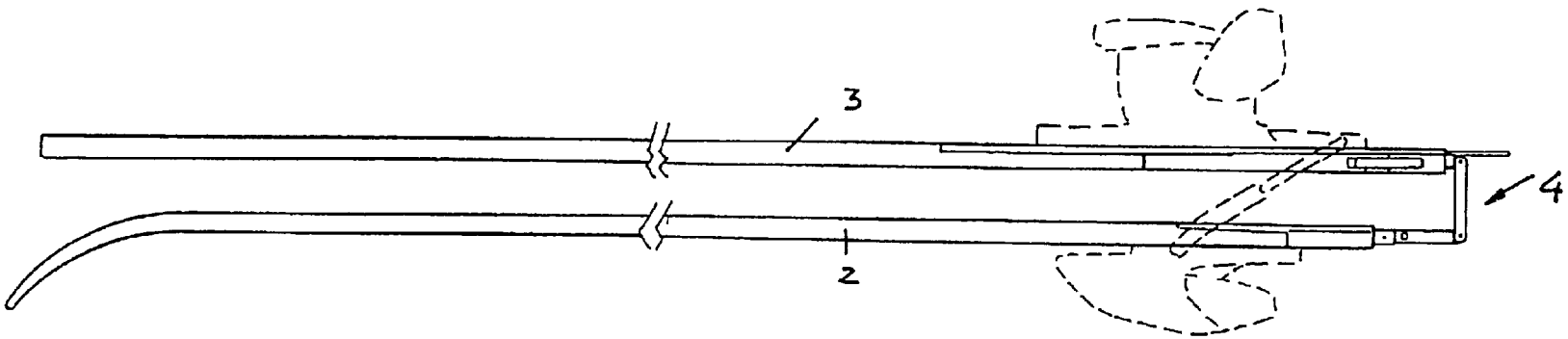
FIG. 2 is a side elevation view showing ski in a folded condition thereof.
Figure 7:
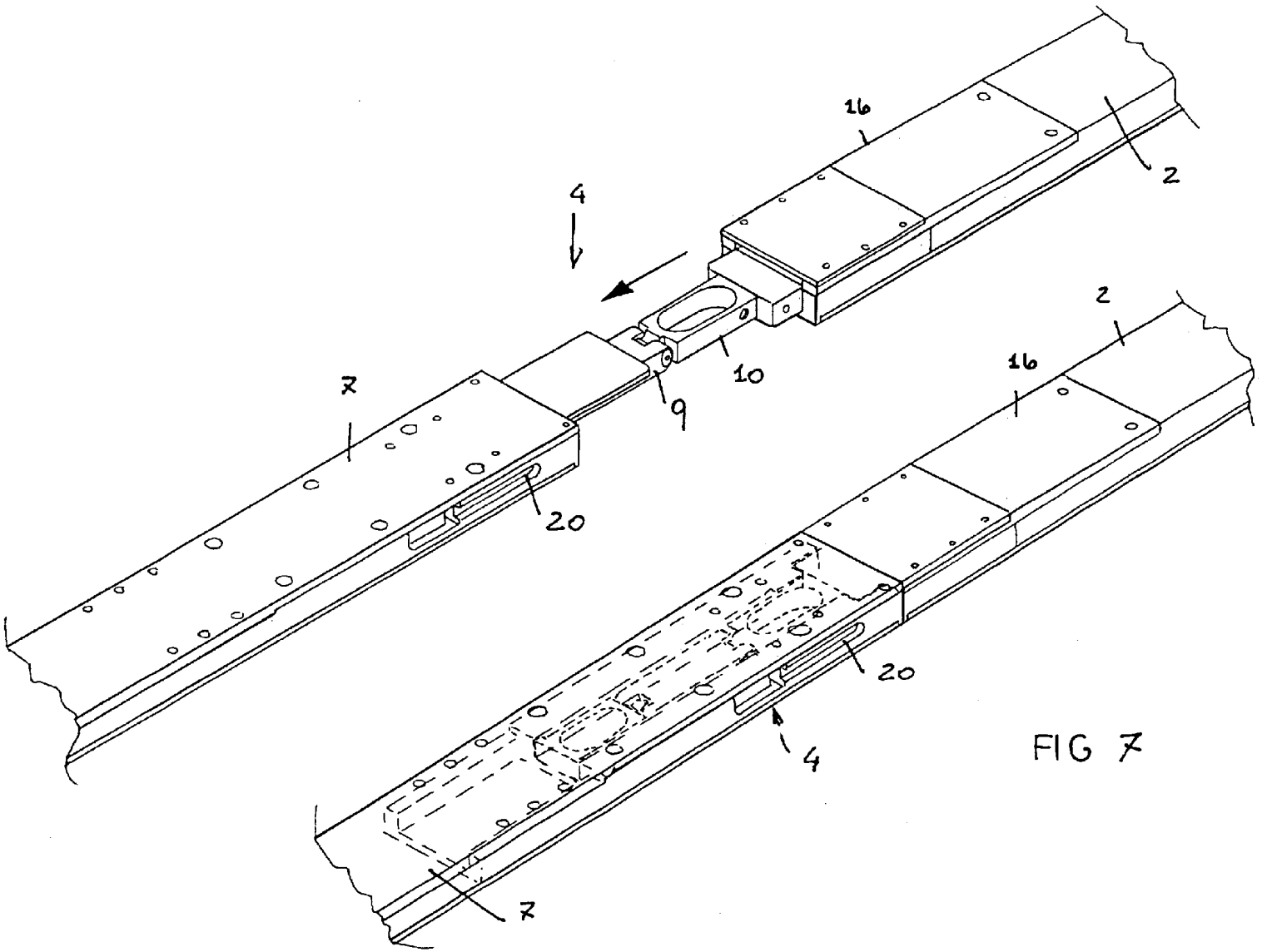
FIG. 7 is a view similar to FIG. 6, showing the skis in a use condition thereof and in an extended position thereof.
Figure 8:
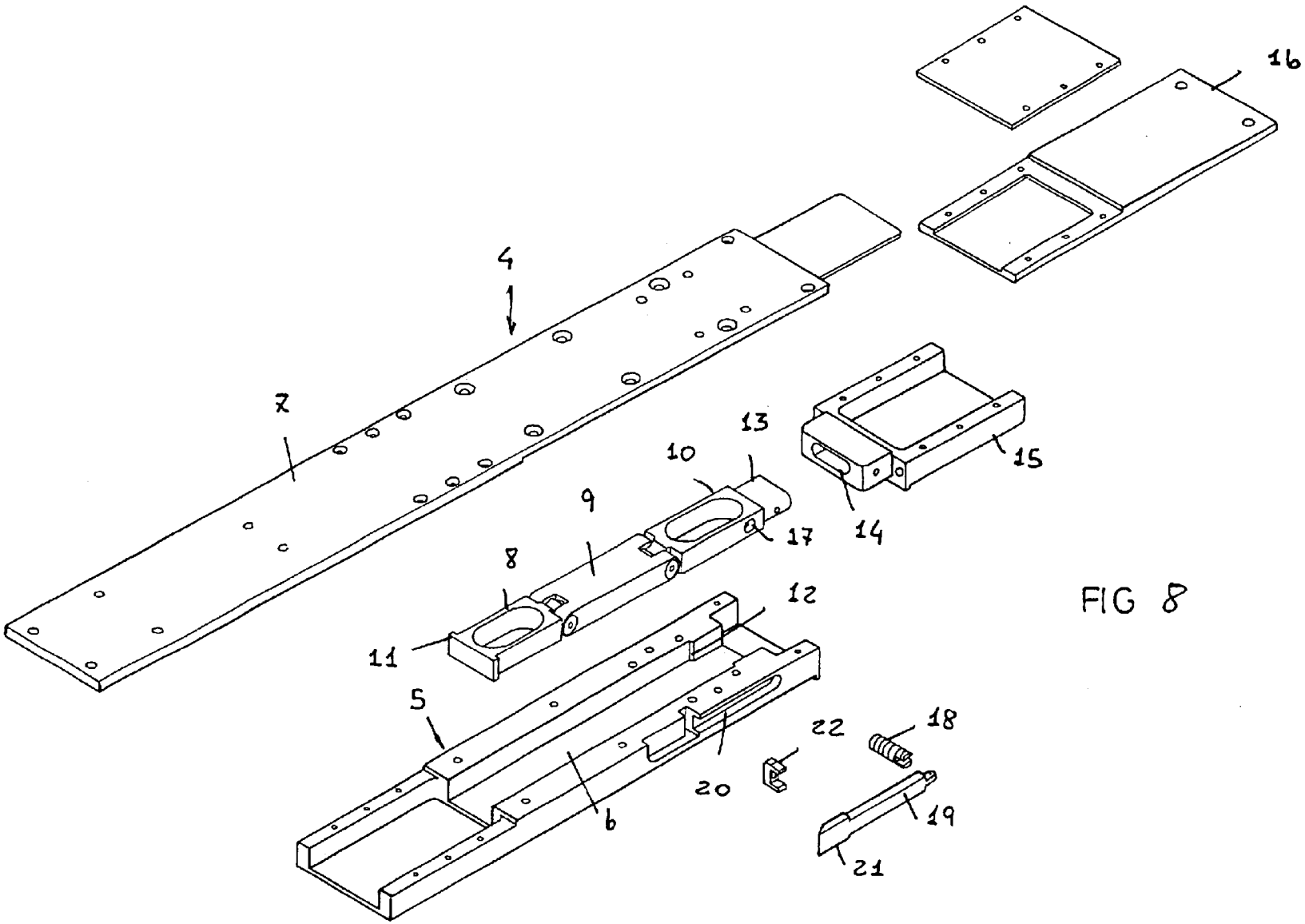
FIG. 8 is a further exploded view of the articulated joint region of the ski shown in the preceding figures.

With reference to the number references of FIGS. 1–8, the foldable ski construction, according to the present invention, which has been generally indicated by the reference number 1, comprises a front ski portion 2 and a rear ski portion 3, coupled front half-ski portion 2 and a rear half-ski portion 3 having substantially equal length, said front half-ski portion 2 and rear half-ski portion 3 being coupled, at respective end portions thereof by at least a foldaway articulated joint means 4, adapted to define at least two positions, of the ski construction, that is a use or extended position, shown in FIGS. 1 and 7, in which the ski portions 2 and 3 are axially aligned, and a folded ski position, shown in FIG. 2, in which the ski portions are substantially parallel and adjoining one another, in an overlapping condition with the ski soles in a facing relationship.

Said foldaway articulated joint 4 comprises a housing 5, including a metal body coupled to one end portion of one of the ski portions, for example to the front end portion of the ski rear portion 3, facing the rear end of the ski front portion 2.

The housing 5 comprises a longitudinally extending recess 6, closed by a top plate 7, which partially extends also on the ski rear portion 3.

The longitudinal recess 6 is designed for slidably engaging therein three mutually pivoted elements, comprising a rear element 8, a central element 9 and a front element 10.

The rear element 8 comprises a shoulder or ridge 11, designed for interfering against a step element 12 formed inside the longitudinal recess 6 for preventing the rear element 8 from exiting said recess 6.

The front element 10 is provided with an end-piece 13 which can be engaged in a hole 14 formed in a small block 15, in turn coupled to the rear end of the ski front portion 2, by a top clamping plate 16.

The front element 10 comprises moreover a laterally extending hole 17, in which can be engaged a pin 18 coupled to a lever 19, in turn laterally pivoted inside a side recess 20, formed on a wall or side of the housing 5.

The lever 19 comprises a push-button 21 which, as it is pressed, causes the lever to turn about a hinge or pivot pin 22 rigid with said housing 5, for causing said pin 18 to be withdrawn from the side hole 17 of the front element 10.

The lever 19 can operate against the biassing of a resilient element.

The rear, central and front elements, respectively 8, 9 and 10, are mutually articulated according to horizontal axes, with respect to the ground position of the ski, respectively indicated by the reference numbers 23 and 24.

Thus, in the folded condition, the ski portions 2 and 3 have their ski soles in a facing relationship, as is clearly visible in FIG. 2.

The connecting pins, respectively 25 and 26, of the rear 8 and front 10 elements comprise recesses 27, for partially housing a ball element, respectively indicated by 28 and 30, operating against the biassing of a respective spring 29 and 31 respectively.

Figure 3:
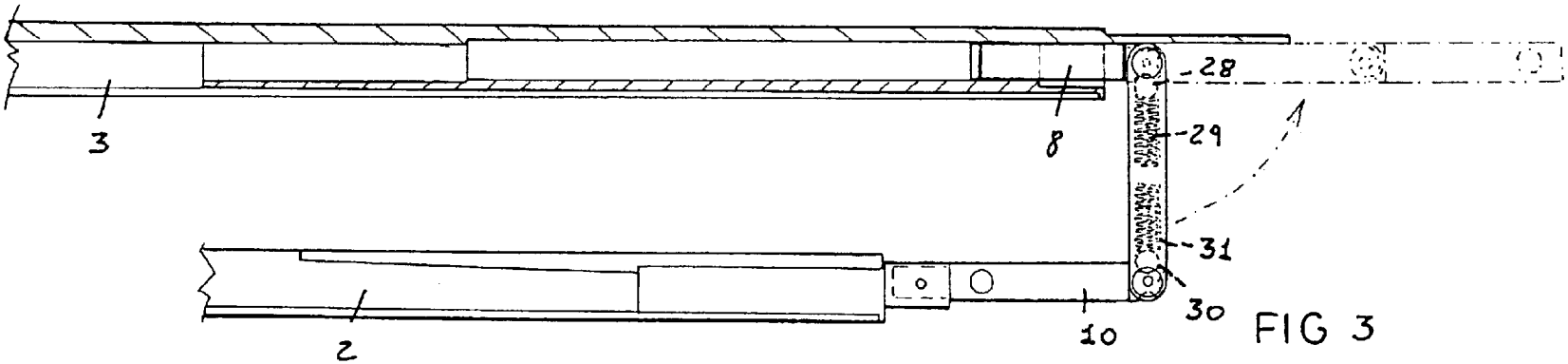
FIG. 3 is a partial side elevation view illustrating the ski at the articulated joint region thereof, in its folded condition, the dashed lines showing the extended joint condition for opening or closing the ski.
Figure 5:
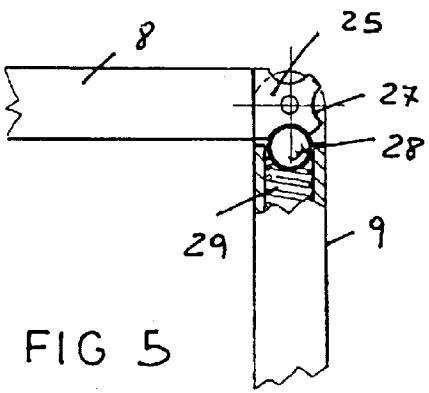
FIG. 5 is a partially cross-sectioned elevation view of the articulated joint shown at a 90° turned position.
Figure 4:
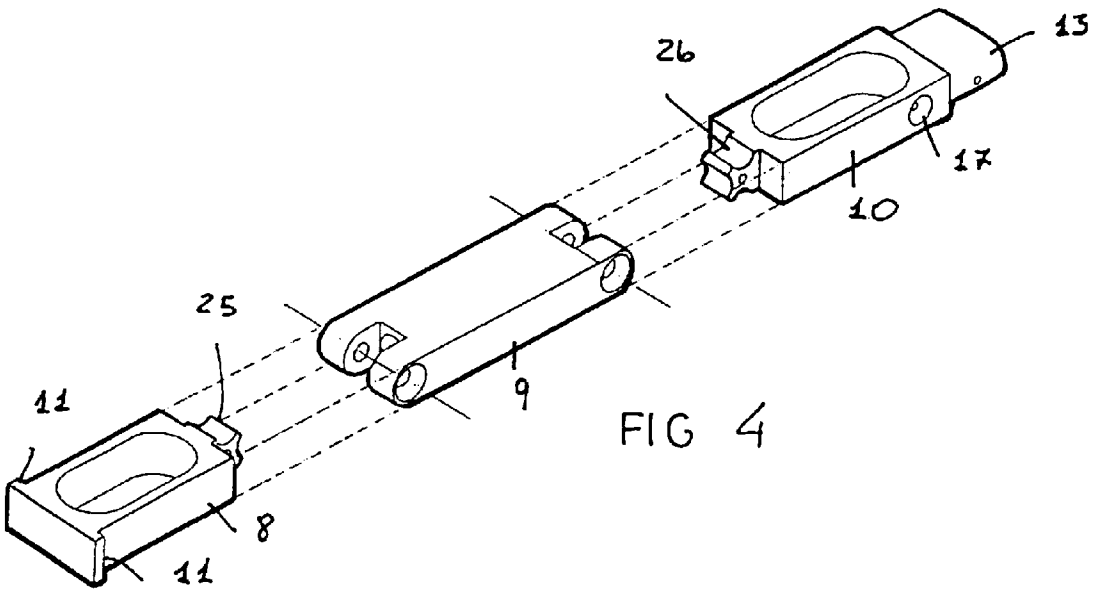
FIG. 4 is an exploded perspective view illustrating the, articulated joint according to the invention.
Figure 6:
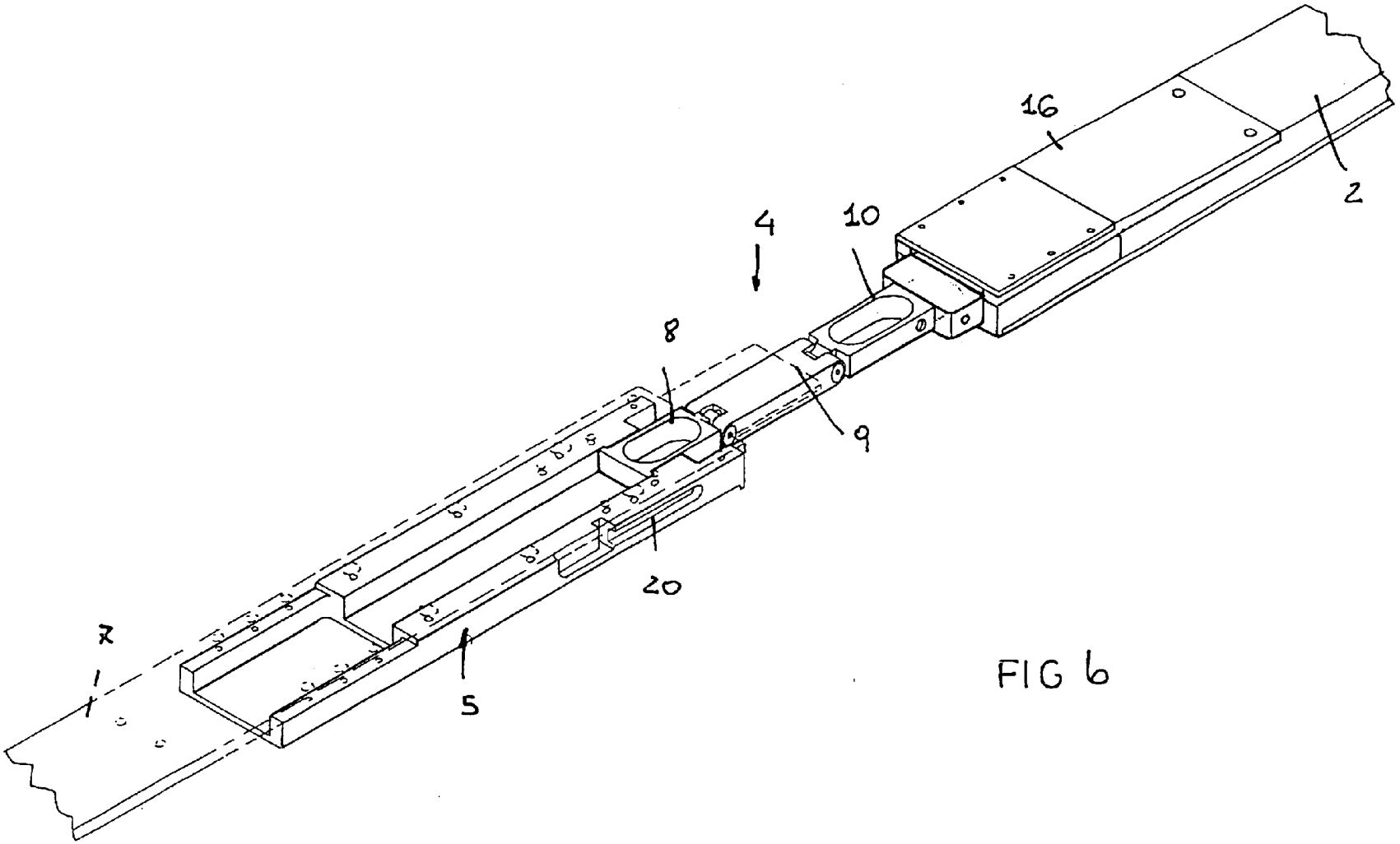
FIG. 6 is a further partial perspective view of the ski articulated joint region shown in the preceding figures.

The springs and related balls are held in said central element 9 and operate to provide discrete positions of the articulated joint, in particular at least a folded ski stable position, as is schematically shown in FIG. 3.

The operation of the foldable ski construction, according to the invention, is as follows.

In the use condition, the pivoted or articulated elements 8, 9 and 10 of the articulated joint 4 are substantially fully engaged in the seat or recess 6 of the housing 5, as is clearly shown in FIG. 7.

For folding the ski, the front element 10 is disengaged from the pin 18, by operating the lever 19, and to the front portion 2 of the ski a pulling force is applied.

Then, the articulated joint is withdrawn to the limit position thereof imposed by the interference of the shoulder 11 of the rear element 8 against the step element 12 formed inside the longitudinal recess 6.

Thus, the articulated joint assembly is prevented from exiting, and the front ski portion 2 is prevented from detaching from the ski rear portion 3.

As the articulated joint assembly has been fully withdrawn, it is possible to fold the ski by arranging the two ski portions in a parallel relationship, as is shown in FIG. 2.

This position is made stable by the stabilizing means comprising the ball and biassing spring system of the central element 9.

To bring the ski to its use condition again, it is sufficient to operate in a reverse direction, by engaging the pin 18 in the side hole 17 of the front element 10, to firmly lock the two ski portions 2 and 3 to one another.

This locking can be automatically performed by an urging spring designed for holding the lever 19 in its closed position.

Thus, as the hole 17 of the front element 10 is arranged on the pin 18, the latter will be automatically urged into said hole by the urging spring.

FIGS. 9–14 show a foldable ski construction according to a further aspect of the invention, which has been generally indicated by the reference number 101.

Figure 10:
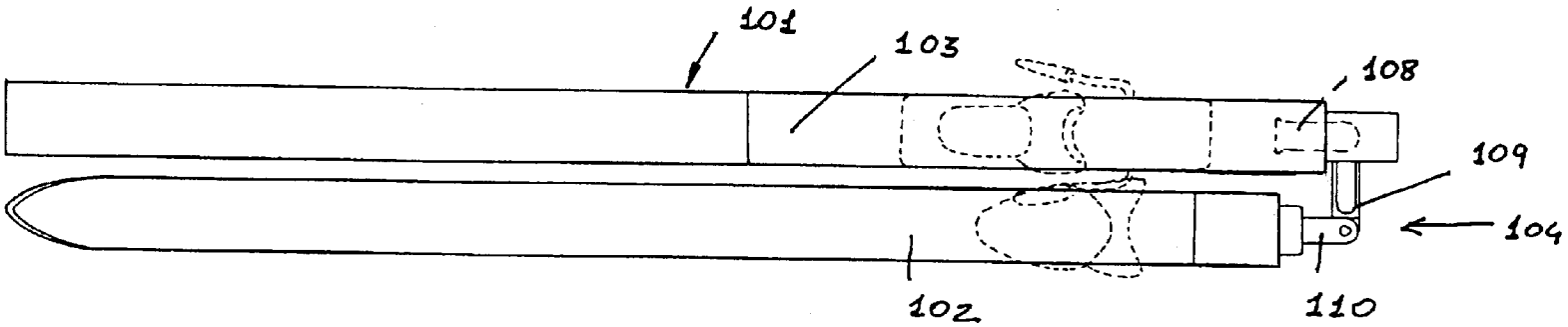
FIG. 10 is a side elevation view illustrating the ski of FIG. 9, in a folded condition thereof.
Figure 9:
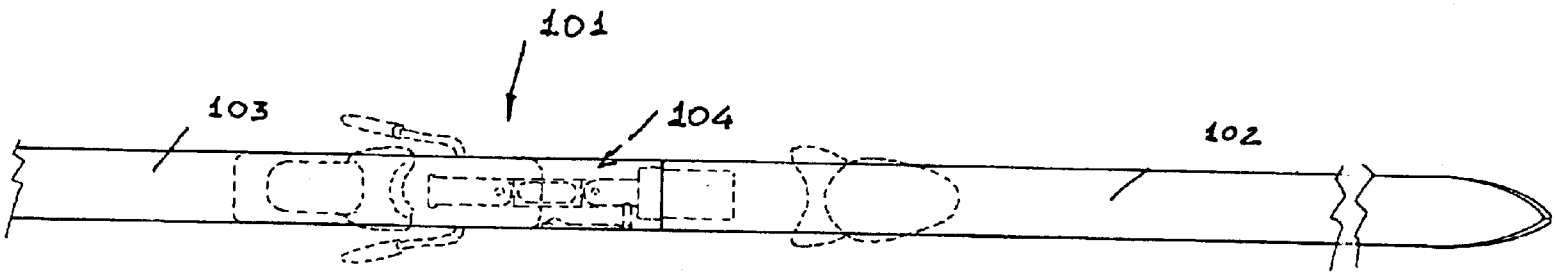
FIG. 9 is a top plan view of a ski construction according to a further aspect of the invention.

Such half-ski construction embodiment comprises a front ski portion 102 and a rear ski portion 103, coupled by at least a foldaway articulated joint 104, designed for defining at least two positions: i.e. a use position, shown in FIG. 9, in which the ski portions 102 and 103 are axially aligned, and a folded position, shown in FIG. 10, in which said ski portions are substantially parallel adjoining one another, with the side blades in a facing relationship (instead of providing facing ski soles as in the preceding embodiment).

The foldaway articulated joint 104 comprises a housing 105, including a metal body coupled at one end of one of the ski portions, for example the front end of the rear ski portion 103 facing the rear end of the front ski portion 102.

The housing 105 comprises a longitudinal extending recess or seat 106, closed by a top plate 107, which also partially extends on the ski rear portion 103.

The longitudinal recess or seat 106 is designed for slidably engaging therein three mutually pivoted elements, respectively constituted by a rear element 108, a central element 109 and a front element 110.

The rear element 108 comprises a shoulder or ridge 111, provided for interfering against a step element 112, formed inside the longitudinal recess 106, to prevent the rear element 108 from exiting said recess 106.

The front element 110 comprises an end piece 113, which can be engaged in a hole 114, formed in a block 115 in turn clamped to the rear end of the ski front portion 102, by a top clamping plate 116.

The front element 110 comprises a laterally extending hole 117 designed for engagement with a pin 118 coupled to a lever 119 in turn laterally pivoted inside a side recess 120 formed on a side of the housing 105.

The lever 119 comprises a push-button 121 which, as it is pressed, causes said lever to turn about a hinge or pivot 122 rigid with the housing 105, for withdrawing the pin 118 from the side hole 117 of the front element 110.

The lever 119 can operate against an urging resilient element.

The rear, central and front elements, respectively 108, 109 and 110 are mutually pivoted or articulated according to vertical axes, with reference to the position of the ski on the ground, which vertical axes have been respectively indicated by the reference numbers 123 and 124.

Thus, in the ski folded condition, the portions 102 and 103 will have their side blades in a facing relationship, as is shown in FIG. 10.

The central element 109 comprises, at the end portions thereof, connecting pins, respectively indicated by 125 and 126, provided with recesses 127 for partially engaging therein a ball element, respectively indicated by 128 and 130, operating against a urging spring, respectively indicated by 129 and 131.

Said springs and respective ball elements are respectively held in the rear element 108 and front element 110 and are designed for providing discrete positions of the articulated joint.

Figure 11:
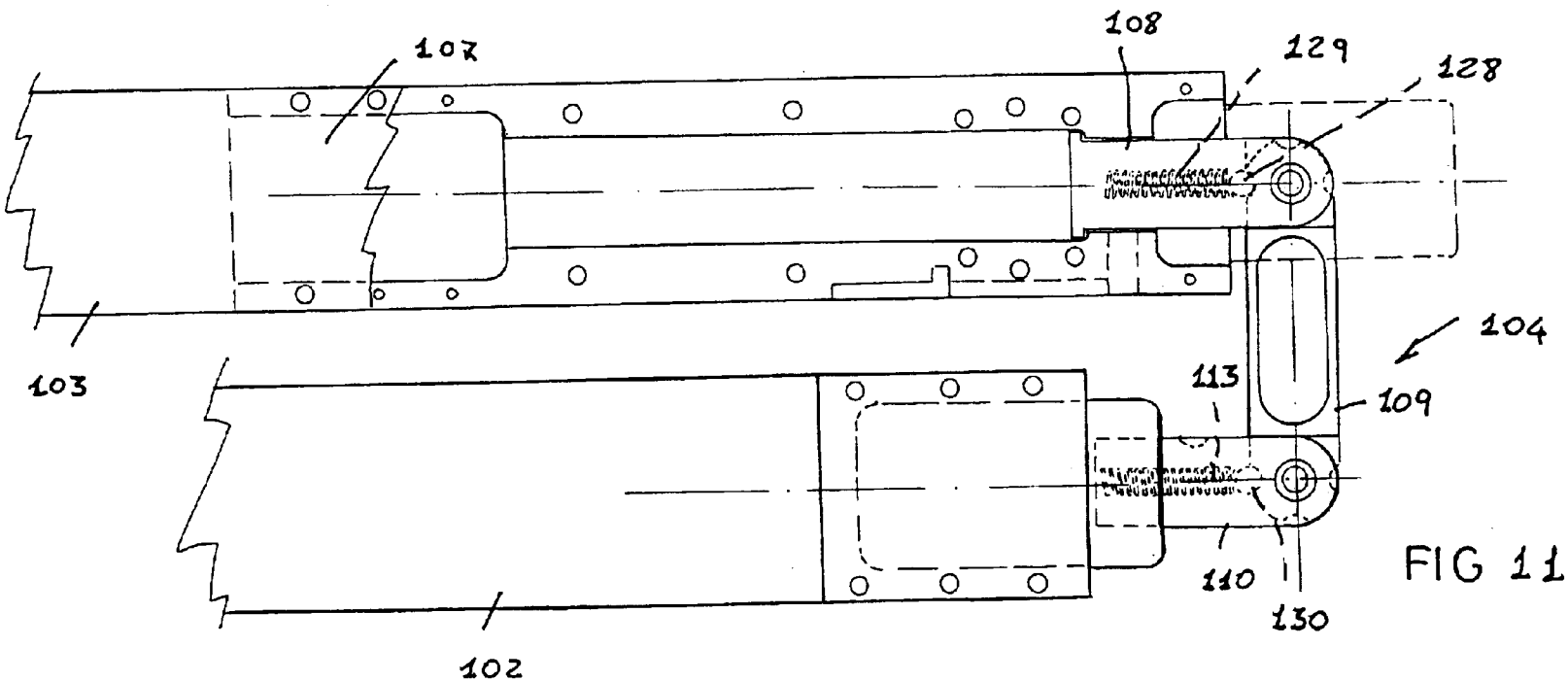
FIG. 11 is a further partial side elevation view illustrating the ski of FIG. 9, at the articulated joint region thereof and in its folded condition.
Figure 12:
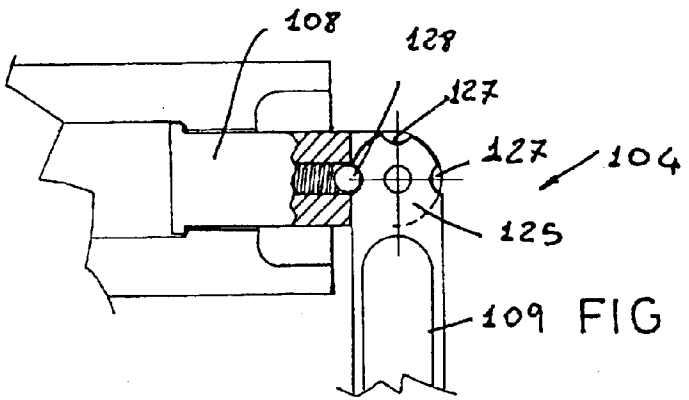
FIG. 12 is a partially cross-sectioned elevation view illustrating the articulated joint of the preceding figure, shown in a 90°-turned condition thereof.
Figure 13:
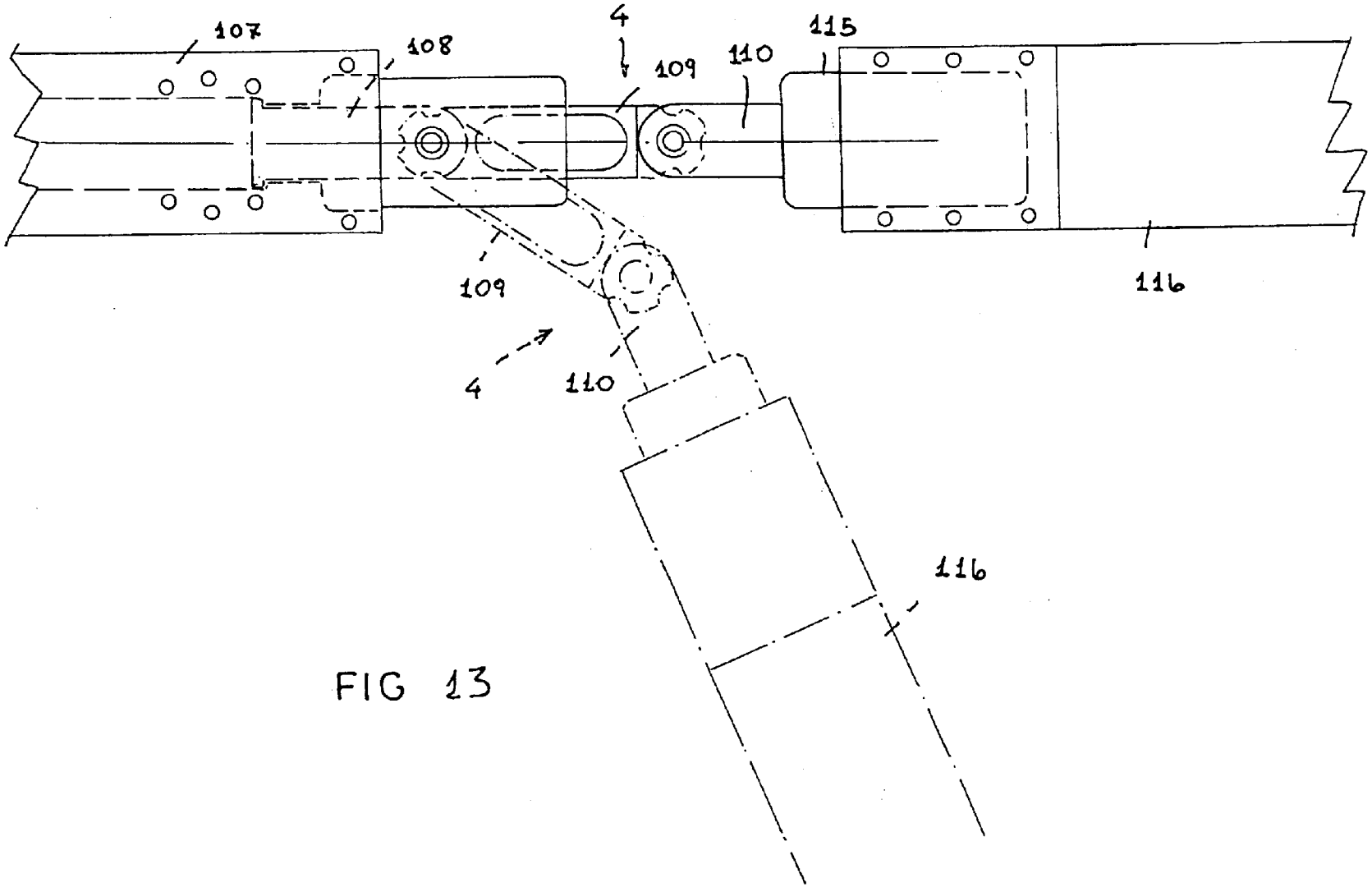
FIG. 13 is a further partial top plan view illustrating the ski of FIG. 9, at the articulated joint region thereof, and in an extended condition, the dashed lines further showing the ski in a partially folded condition thereof.
Figure 14:
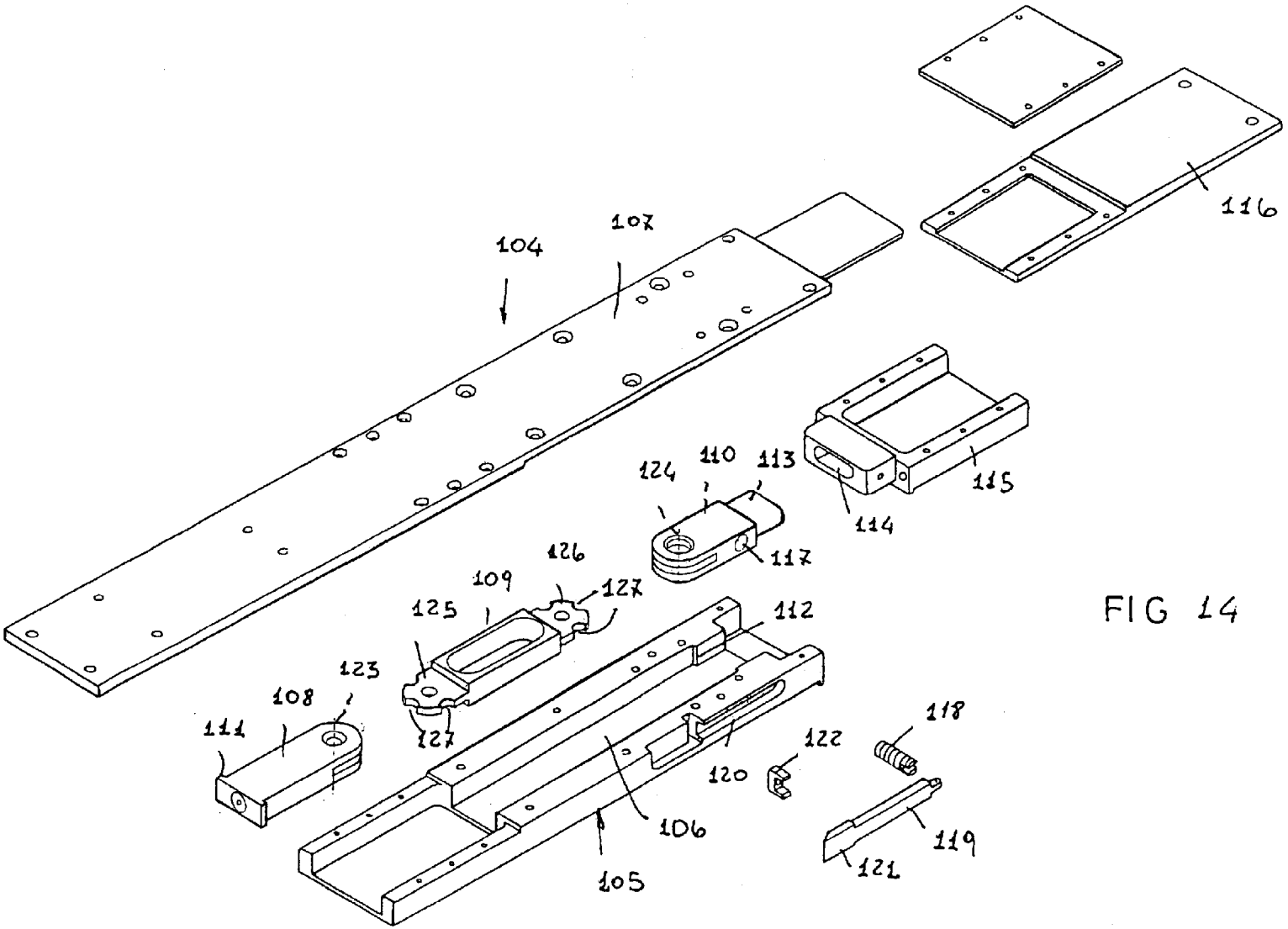
FIG. 14 is an exploded view of the articulated joint region of the ski shown in FIGS. 9 to 13.

More specifically, at least a folded ski stable position is provided, as is schematically shown in FIG. 11.

The foldable sky construction according to this embodiment of the invention operates as follows:

In a use condition, the articulated elements 108, 109 and 110 of the articulated joint 104 are substantially fully engaged in the recess or seat 106 of the housing 105.

For folding the ski, the front element 110 is disengaged from the pin 118, by operating the lever 119, and the front portion 102 of the ski is pulled so as to withdraw the articulated joint up to the limit position imposed by the interference of the shoulder 111 of the rear element 108 against the step element 112 formed inside the longitudinal recess 106, to prevent the articulated joint assembly from exiting and the front ski portion 102 from disengaging from the rear ski portion 103.

As the articulated joint assembly has been fully withdrawn, the ski can be folded by arranging the two ski portions parallel to one another, as is clearly shown in FIG. 10. This position is made stable by the above disclosed stabilizing means comprising the articulated joint assembly ball and spring system.

To bring the ski to its use condition again, it would be sufficient to operate in a reverse direction, i.e. by engaging the pin 118 in the side hole 117 of the front element 110 to stably lock the two portions 102 and 103 to one another. This locking can be performed in an automatic manner by an urging spring adapted to hold the lever 119 in its closed position.

Thus, as the hole 117 of front element 110 is arranged on said pin 118, the latter will be automatically urged into said hole by the urging spring.

It has been found that the invention fully achieves the intended aim and objects.

In fact, the invention provides a foldable ski construction, allowing to quickly and easily fold and extend again the ski, by a quick and easy operation, thereby solving all the problems related to the transportation of the skies.

In practicing the invention, the used materials, as well as their contingent size and shapes, can be any, depending on requirements and the status of the art.

However, it would be advantageous to choose the materials for preventing the disclosed ski elements from oxidating, thereby preventing oxidation processes, in order to prevent possible sizing thereof.

Another consideration related to the preferred materials is that the mechanical components of the skis must not be subjected to excessive thermal expansions.

Moreover, the friction of the component parts must be minimum, and this can be achieved, for example for facilitating the sliding of the articulated joint in its seat, by using an universal lubricating material such a lubricating oil or petrolatum or any other suitable special lubricating agents.

With respect to the articulated joints, the preferred materials should be, for example, stainless steel, teflon, special plastics materials, bronze, brass and the like.

For the recesses or seats, preferred materials would be, for example, aluminiumergal materials, providing a very reduced friction.

The plates and caps are preferably made of materials such as stainless steel and aluminiumergal materials.

With respect to the locking pin, it would be possible to use a plastics material such as teflon or special plastics materials having a very low wearing rate.

What is claimed is:

1. A foldable ski construction, said ski construction including a pair of skis, each ski being defined by a ski blade having a ski sole and comprising a front half-ski portion and a rear half-ski portion, said front half-ski portion and said rear half-ski portion having substantially equal lengths and being coupled to each other, at respective end portions thereof, by an articulated foldaway joint means designed for defining at least two ski positions comprising an extended use position in which said front and rear half-ski portions are axially aligned, and a folded non-use position, in which said front and rear half-ski portions are substantially overlapping, adjoining and parallel to one another, said articulated foldaway joint means comprises a housing including a metal body coupled to an end of one of said ski portions, said housing being coupled to a front end of said rear half-ski portion facing a rear end of said front half-ski portion, said housing comprising a longitudinally extending recess closed by a top plate, which partially extends on said rear half-ski portion, said longitudinally extending recess slidingly engages therein three mutually articulated elements comprising a rear element, a central element and a front element, said rear element comprises a shoulder interfacing against a step element formed inside said longitudinally extending recess, to prevent said rear element from exiting said recess, said front element including an end piece which can be engaged in a hole formed in a block, in turn coupled to a rear end of said ski front portion, by a top plate, wherein said front element further comprises a side hole engaging with a pin coupled to a lever laterally pivoted inside a laterally extending recess, formed on a side of said housing.

2. A ski construction, according to claim 1, wherein said lever comprises a push-button which, as it is pressed, causes said lever to turn about a pivot rigid with said housing for withdrawing said pin from said side hole of said front element.

3. A ski construction, according to claim 1, wherein said lever is urged by a resilient element.

* * * * *